US009291957B2

(12) United States Patent
Suzuki

(10) Patent No.: US 9,291,957 B2
(45) Date of Patent: Mar. 22, 2016

(54) IMAGE FORMING APPARATUS WITH RECIPROCATING MECHANISM FOR CLEANING BLADE

(71) Applicant: CANON KABUSHIKI KAISHA, Tokyo (JP)

(72) Inventor: Kenji Suzuki, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/580,726

(22) Filed: Dec. 23, 2014

(65) Prior Publication Data

US 2015/0177673 A1 Jun. 25, 2015

(30) Foreign Application Priority Data

Dec. 25, 2013 (JP) ..... 2013-268054

(51) Int. Cl.
*G03G 15/16* (2006.01)
*G03G 21/00* (2006.01)

(52) U.S. Cl.
CPC ..... *G03G 15/168* (2013.01); *G03G 15/1605* (2013.01); *G03G 21/0011* (2013.01); *G03G 21/0035* (2013.01); *G03G 2215/0129* (2013.01)

(58) Field of Classification Search
CPC ..... G03G 21/0011; G03G 21/0035; G03G 15/168; G03G 15/1605; G03G 2215/0129
USPC ..... 399/101, 98, 99, 350, 351
See application file for complete search history.

(56) References Cited

U.S. PATENT DOCUMENTS

| | | | | |
|---|---|---|---|---|
| 7,502,574 | B2 | 3/2009 | Suzuki et al. | |
| 8,886,089 | B2 | 11/2014 | Toyama et al. | |
| 2011/0013927 | A1 * | 1/2011 | Sugiyama | 399/99 |

FOREIGN PATENT DOCUMENTS

| | | | | | |
|---|---|---|---|---|---|
| JP | 06-194894 | A | | 7/1994 | |
| JP | 2000075757 | A | * | 3/2000 | G03G 21/10 |
| JP | 2007121965 | A | * | 5/2007 | |
| JP | 2013-29707 | A | | 2/2013 | |
| JP | 2013-83800 | A | | 5/2013 | |

* cited by examiner

*Primary Examiner* — Billy Lactaoen
(74) *Attorney, Agent, or Firm* — Fitzpatrick, Cella, Harper & Scinto

(57) ABSTRACT

An image forming apparatus includes: an image bearing member; a belt; a cleaning blade; a reciprocating mechanism for reciprocating the cleaning blade in the width direction so that one end portion thereof is between first and second positions and the other end portion thereof is between third and fourth positions; and a brush, extending in the width direction, for removing the toner deposited on the belt in contact with the outer peripheral surface of the belt. The brush is provided upstream of the cleaning blade and downstream of the transfer portion with respect to the movement direction of the belt so that one end portion of the brush is between the first and second positions and the other end portion of the brush is between the third and fourth positions.

5 Claims, 5 Drawing Sheets

IMAGE FORMING APPARATUS WITH RECIPROCATING MECHANISM FOR CLEANING BLADE

FIELD OF THE INVENTION AND RELATED ART

The present invention relates to an image forming apparatus, such as a copying machine, a printer or a facsimile machine, of an electrophotographic type or an electrostatic recording type.

In a conventional image forming apparatus using, e.g., the electrophotographic type, a cleaning device is used for removing and collecting a toner deposited on an image bearing member such as a photosensitive member or an intermediary transfer member. This is because the toner (transfer residual toner) remaining on the image bearing member after a toner image is transferred from the image bearing member onto a transfer-receiving member such as a transfer material should be removed and collected. Further, the cleaning device is used also for removing and collecting the toner deposited on a transfer material feeding member for carrying and feeding the transfer material in contact with the image bearing member at a transfer portion. This is because a toner (patch toner) for a test image formed for image density adjustment and registration color toners or a toner (fog toner) deposited on a non-image portion during development is deposited on the recording material feeding member via the image bearing member, and therefore these toners should be removed and collected. The cleaning device for cleaning a toner carrying member such as the image bearing member or the transfer material feeding member includes, in general, a cleaning member such as a cleaning blade provided in contact with the toner carrying member.

For example, as described in Japanese Laid-Open Patent Application (JP-A) 2013-83800, a cleaning device including a fur brush and a cleaning blade is used for removing and collecting the patch toner or the fog toner from a secondary transfer belt as the transfer material feeding member contacting an intermediary transfer belt. In such a constitution, the fur brush has functions of removing, collecting and re-coating the toner and of removing and collecting paper powder. The cleaning blade has a function of scraping off the toner which slips through the fur brush. The fur brush is capable of holding the toner in a certain amount, and even in a state in which an amount of the toner transferred from the intermediary transfer belt onto the secondary transfer belt is small, it is possible to supply the toner little by little from the fur brush to the cleaning blade. As a result, the toner functions as a lubricant between the cleaning blade and the intermediary transfer belt, so that it is possible to suppress generation of an inconvenience such as turning-up of the cleaning blade. Further, by removing and collecting the paper powder with the fur brush, it is possible to suppress generation of an inconvenience such that the paper powder reaches the cleaning blade and is sandwiched between the cleaning blade and the secondary transfer belt, and then the toner slips through between the cleaning blade and the secondary transfer belt.

Similarly, as described in JP-A 2013-29707, as a cleaning device for removing and collecting the transfer residual toner or the like from the intermediary transfer belt, a cleaning device including a fur brush and a cleaning blade is used.

However, even when the fur brush is used in the cleaning device, the fur brush cannot sufficiently remove the paper powder in some cases. In such cases, defective cleaning generates in some cases due to a phenomenon that the paper powder reaches the cleaning blade after passing through the fur brush and then is sandwiched between the cleaning blade and the toner carrying member, and thereafter the toner slips through between the cleaning blade and the toner carrying member.

Further, in the case where a width of the fur brush is smaller than a width of the cleaning blade with respect to a direction crossing a toner feeding direction by the toner carrying member, the toner is not fed from the fur brush to an end portion of the cleaning blade. For that reason, the inconvenience such as the turning-up of the end portion of the cleaning blade can generate. On the other hand, with respect to the direction crossing the toner feeding direction by the toner carrying member, when the fur brush width is longer than the cleaning blade width more than necessary, an unnecessary toner is supplied to an outside of the cleaning blade. For that reason, toner scattering is caused.

Here, with respect to the toner feeding direction by the toner carrying member, it would be considered that the widths of the fur brush and the cleaning blade are made equal to each other. However, in general, when a part tolerance and a part mounting tolerance are taken into consideration, it is difficult to eliminate deviation in a relationship between the widths of the fur brush and the cleaning blade, thus causing the above-described turning-up of the cleaning blade and toner scattering in some cases.

SUMMARY OF THE INVENTION

According to an aspect of the present invention, there is provided an image forming apparatus comprising: an image bearing member for bearing a toner image; a movable belt for feeding a recording material onto which the toner image is to be transferred from the image bearing member at a transfer portion; a cleaning blade, extending in a width direction crossing a movement direction of the belt, for removing a toner deposited on the belt in contact with an outer peripheral surface of the belt; a reciprocating mechanism for reciprocating the cleaning blade in the width direction so that one end portion thereof is between first and second positions and the other end portion thereof is between third and fourth positions; and a brush, extending in the width direction, for removing the toner deposited on the belt in contact with the outer peripheral surface of the belt, wherein the brush is provided upstream of the cleaning blade and downstream of the transfer portion with respect to the movement direction of the belt so that one end portion of the brush is between the first and second positions and the other end portion of the brush is between the third and fourth positions.

These and other objects, features and advantages of the present invention will become more apparent upon a consideration of the following description of the preferred embodiments of the present invention taken in conjunction with the accompanying drawings.

DESCRIPTION OF THE EMBODIMENTS

Figure 1:
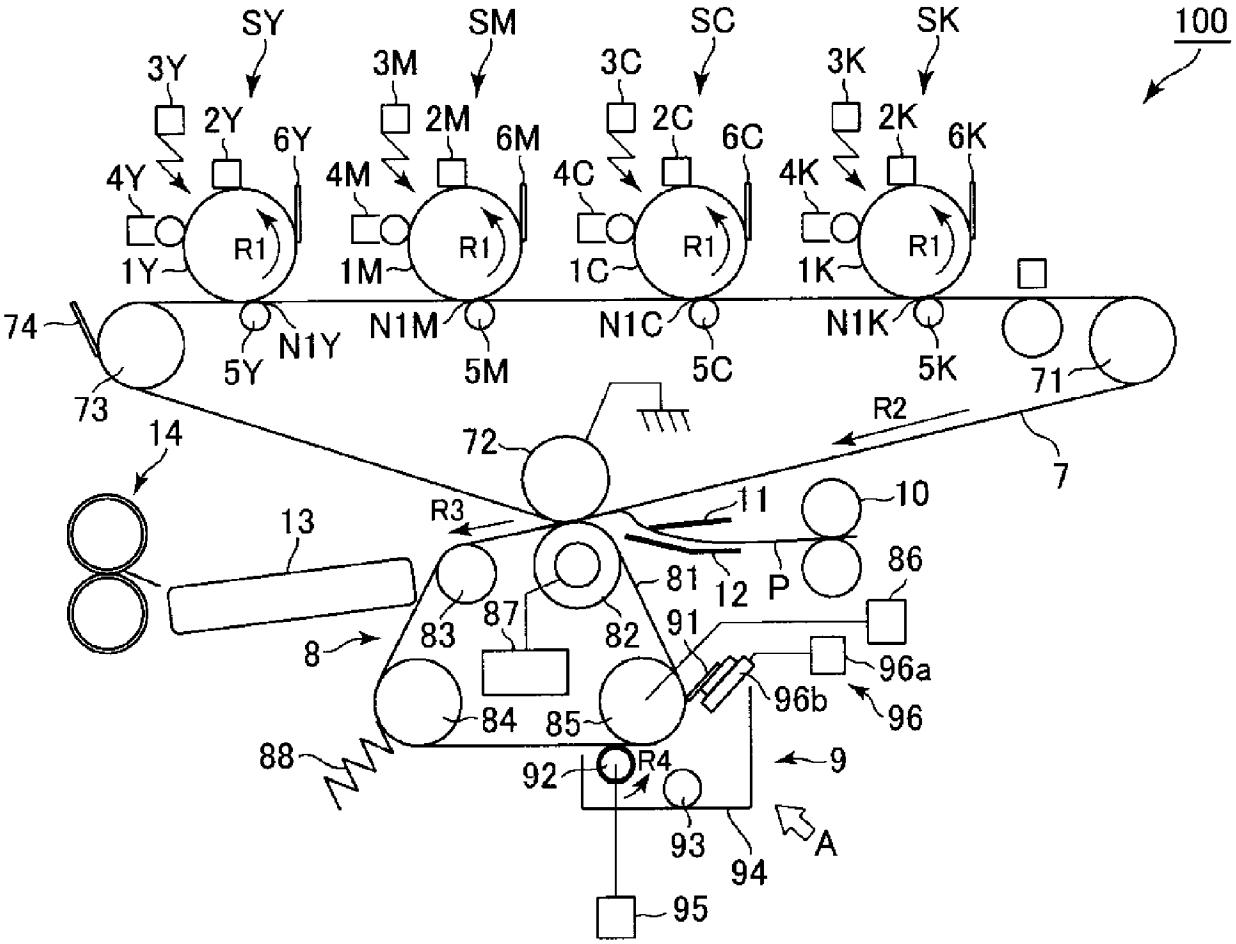
FIG. 1 is a schematic sectional view of an image forming apparatus according to Embodiment 1 of the present invention.

A cleaning device and an image forming apparatus according to the present invention will be described with reference to the drawings.

Embodiment 1

1. General Constitution and Operation of Image Forming Apparatus

An image forming apparatus 100 in this embodiment is a tandem printer which is capable of forming a full-color image using an electrophotographic type and which employs an intermediary transfer type.

The image forming apparatus 100 includes, as a plurality of image forming portions, first to fourth image forming portions (stations) SY, SM, SC and SK for forming images of yellow (Y), magenta (M), cyan (C) and black (K), respectively. These four image forming portions SY, SM, SC and SK are provided and arranged along a movement direction of an intermediary transfer belt 7 described later. In this embodiment, constitutions and operations of the image forming portions SY, SM, SC and SK are substantially the same except that the colors of toners used are different from each other. Accordingly, in the following, in the case where particular distinction is not required, suffixes Y, M, C and K for representing elements for associated colors are omitted, and the elements will be collectively described.

At the image forming portion S, a photosensitive drum 1 which is a drum-shaped (cylindrical) electrophotographic photosensitive member as a first image bearing member is provided. The photosensitive drum 1 is rotationally driven in an arrow R1 direction. At a periphery of the photosensitive drum 1, along a rotational direction of the photosensitive drum 1, the following means are provided in the listed order. First, a primary charging device (corona charger) 2 as a charging means is disposed. Next, an exposure device (laser scanner device) 3 as an exposure means is disposed. Next, a developing device 4 as a developing means is disposed. Next, primary transfer rollers 5 which are roller-shaped primary transfer members as primary transfer means. Next, a drum cleaning device 6 as a photosensitive member cleaning means is disposed.

Further, the intermediary transfer belt 7, as a second image bearing member, which is an intermediary transfer member formed with an endless belt is disposed so as to oppose the four photosensitive drums 1Y, 1M, 1C and 1K. The intermediary transfer belt 7 is also a transfer-receiving member onto which the toner image is to be transferred. The intermediary transfer belt 7 is stretched by, as a plurality of stretching rollers (supporting rollers), a tension roller 71, a secondary transfer opposite roller 72 and a driving roller 73. The intermediary transfer belt 7 is rotated (moved and circulated) in an arrow R2 direction by rotational drive of the driving roller 73. In an inner peripheral surface side of the intermediary transfer belt 7, at positions opposing the photosensitive drums 1, the above-described primary transfer rollers 5 are disposed. Each of the primary transfer rollers 5 is urged (pressed) against the intermediary transfer belt 7 toward the associated photosensitive drum 1, so that a primary transfer nip (primary transfer portion) N1 where the intermediary transfer belt 7 and the photosensitive drum 1 contact each other is formed. Further, in an outer peripheral surface side of the intermediary transfer belt 7, at a position opposing the secondary transfer opposite roller 72, a secondary transfer unit 8 described later is disposed, so that a secondary transfer portion (secondary transfer nip) N2 where a secondary transfer belt 81 described later and the intermediary transfer belt 7 contact each other. Further, in the outer peripheral surface side of the intermediary transfer belt 7, at a position opposing the driving roller 73, an intermediary transfer belt cleaning device 74 as an intermediary transfer member cleaning means is disposed.

Further, in the image forming apparatus 100, a transfer material feeding device for feeding a transfer material P as a transfer-receiving member to the secondary transfer portion N2 and a fixing device for fixing the toner image on the transfer material P, and the like are provided.

During image formation, a surface of the rotating photosensitive drum 1 is electrically charged substantially uniformly to a predetermined polarity (negative in this embodiment) and a predetermined potential by the primary charging device 2. The charged photosensitive drum 1 is subjected to scanning exposure depending on image information by the exposure device 3. As a result, an electrostatic latent image (electrostatic image) depending on the image information is formed on the photosensitive drum 1. The electrostatic latent image formed on the photosensitive drum 1 is developed with the toner as a developer by the developing device 4, so that the toner images are formed on the photosensitive drum 1. In this embodiment, a reverse developing method in which the development is made by depositing the toner, charged to the same polarity as a charge polarity of the photosensitive drum 1, on an exposed portion of the photosensitive drum 1 where an absolute value of the potential is lowered by exposing a light the surface of the photosensitive drum 1 after the substantially uniform charging is used. In the four developing devices 4Y, 4M, 4C and 4K, the toners of yellow, magenta, cyan and black are accommodated, respectively. The toner image formed on the photosensitive drum 1 is electrostatically transferred (primary-transferred) onto the rotating intermediary transfer belt 7 at the primary transfer portion N1 by the action of the associated primary transfer roller 5. For example, during full-color image formation, the above-described steps of charging, exposure development and primary transfer are carried out at the first to fourth image forming portions SY, SM, SC and SK, so that the respective color toner images are successively primary-transferred superposedly onto the intermediary transfer belt 7 at the respective primary transfer portions N1.

On the other hand, in a transfer material feeding device, the transfer material P such as a recording sheet is accommodated in an unshown transfer material cassette. In the transfer material feeding device, an unshown feeding roller is driven on the basis of a transfer material feeding start signal, so that the transfer material P in the transfer material cassette is fed one by one to a registration roller pair 10. The transfer material P fed to the registration roller pair 10 is once stopped thereat, and then is fed to the secondary transfer portion N2 by the registration roller pair 10 in synchronism with the feeding of the toner images on the intermediary transfer belt 7. With respect to the feeding direction of the transfer material P, an upper guiding member 11 and a lower guiding member 12 are provided upstream of the secondary transfer portion N2. The upper guiding member 11 is disposed in a surface side of the intermediary transfer belt 7 and regulates a behavior of the transfer material P approaching the surface of the intermediary transfer belt 7. Further, the lower guiding member 12 is disposed in an opposite side from the surface side of the intermediary transfer belt 7 relative to the upper guiding member 11, and regulates a behavior of the transfer material P moving apart from the surface of the intermediary transfer belt 7. By these guiding members, a feeding path in which the transfer material P is fed from the registration roller pair 10 to the secondary transfer portion N2 is regulated.

The toner images formed on the intermediary transfer belt 7 are sent to the secondary transfer portion N2 with rotation of the intermediary transfer belt 7. Then, these toner images are electrostatically transferred (secondary-transferred) onto the transfer material P fed by a secondary transfer belt 81 described later, at the secondary transfer portion N2. Thereafter, the transfer material P carrying thereon the toner images is carried to a fixing device 14 by a pre-fixing feeding device 13, and then the (unfixed) toner images are fixed on the transfer material P by the fixing device 14. Thereafter, the transfer material P is discharged to an outside of the image forming apparatus 100.

A deposited matter such as the toner remaining on the photosensitive drum 1 after the primary transfer is removed and collected from the photosensitive drum 1 by the drum cleaning device 6. Further, a deposited matter such as the toner remaining on the intermediary transfer belt 7 after the secondary transfer is removed and collected from the intermediary transfer belt 7 by an intermediary transfer belt cleaning device 74.

The electrostatic latent image formed by the exposure device 3 is a group of small dotted images, and by changing a density of the dotted images, it is possible to change a density of the toner image to be formed on the photosensitive drum 1. In this embodiment, each of the color toner images is about 1.5-1.7 in maximum density, and is about 0.4-0.6 mg/cm$^2$ in toner amount per unit area at the maximum density.

Further, the intermediary transfer belt 7 is disposed in contact with the surface of the photosensitive drum 1, and is stretched by the plurality of stretching rollers including the tension roller 71, the secondary transfer opposite roller 72 and the driving roller 73, and is rotated in the arrow R2 direction in FIG. 1 at a speed of 250-300 mm/sec. The tension roller 71 constitutes the tension of the intermediary transfer belt 7 at a substantially constant level. The driving roller 73 transmits a driving force to the intermediary transfer belt 7. Further, the secondary transfer opposite roller 72 opposes a secondary transfer roller 82 described later via the intermediary transfer belt 7 and the secondary transfer belt 81 between which the secondary transfer portion N2 is formed. As the intermediary transfer belt 7, a belt prepared by adding carbon black as an antistatic agent in an appropriate amount into a resin material such as polyimide or polycarbonate, or into various rubbers may preferably be used. The intermediary transfer belt 7 may preferably be $1\times10^9$-$1\times10^{14}$ Ω·cm in volume resistivity and 0.07-0.1 mm in thickness.

2. Secondary Transfer Unit

A secondary transfer unit 8 includes the secondary transfer belt 81 as a transfer material feeding member formed with an endless belt which is an example of the toner carrying member. The secondary transfer belt 81 is stretched by a plurality of stretching rollers (supporting rollers) including the secondary transfer roller 82, a separation roller 83, a tension roller 84 and a driving roller 85. In this embodiment, along the rotational direction of the secondary transfer belt 81, the secondary transfer roller 82, the separation roller 83, the tension roller 84 and the driving roller 85 are disposed in the listed order. The secondary transfer roller 82 has the function of a roller-shaped secondary transfer member as a secondary transfer means. The separation roller 83 has the function of separating the transfer material P from the secondary transfer belt 81. The tension roller 84 is urged by a spring 88 as an urging means, thus imparting a predetermined tension to the secondary transfer belt 81. The driving roller 85 is rotationally driven by a driving mechanism including a secondary transfer belt driving motor 86 as a driving source, so that the secondary transfer belt 81 is rotated (moved and circulated) in an arrow R3 direction in FIG. 1.

To the secondary transfer roller 82, a secondary transfer voltage source (high-voltage source) 87 for variably supplying a bias is connected as an applying means. Further, at a position where the secondary transfer roller 82 and the secondary transfer opposite roller 72 oppose each other via the intermediary transfer belt 7 and the secondary transfer belt 81, the secondary transfer roller 82 is urged (pressed) toward the secondary transfer opposite roller 72. As a result, the secondary transfer portion N2 where the intermediary transfer belt 7 and the secondary transfer belt 81 contact each other is formed. When the transfer material P passes through the secondary transfer portion N2, from the secondary transfer voltage source 87 to the secondary transfer roller 82, a secondary transfer voltage (secondary transfer bias) of an opposite polarity to the charge polarity of the toner during the development, so that a secondary transfer current flows into the secondary transfer portion N2. As a result, not only the toner images are secondary-transferred from the intermediary transfer belt 7 onto the transfer material P fed to the secondary transfer portion N2, but also the transfer material P is attracted to the secondary transfer belt 81 by a supplied electrostatic force. For example, in this embodiment, during the secondary transfer, a current of +40 μA to +60 μA is passed through the secondary transfer portion N2.

The secondary transfer roller 82 is constituted by providing, on an outer peripheral surface of a core metal, an elastic layer formed with an ion-conductive foamed rubber (NBR rubber). This secondary transfer roller 82 is 24 mm in outer diameter, 6.0-12.0 μm in surface roughness Rz (ten-point average roughness according to JIS), and $1\times10^5$-$1\times10^7$Ω in electric resistance as measured under application of a voltage of 2 kV in an N/N (23° C./50% RH) environment. The elastic layer is 30-40 degrees in Asker-C hardness.

The secondary transfer belt 81 is moved in the arrow R3 direction in FIG. 1, so that the transfer material P attracted to the surface of the secondary transfer belt 81 is fed to a downstream side. Then, at a time when the transfer material P on the secondary transfer belt 81 reaches a position of the separation roller 83 disposed downstream of the secondary transfer roller 82, the transfer material P is separated from the surface of the secondary transfer belt 81 by curvature of the separation roller 83. Then, the transfer material P separated from the secondary transfer belt 81 is fed to the pre-fixing feeding device 13 disposed downstream of the secondary transfer unit 8.

As the secondary transfer belt 81, a belt prepared by adding carbon black or the like as the antistatic agent into the resin material such as polyimide or polyamide may suitably be used. The secondary transfer belt 81 may preferably be $1\times10^9$-$1\times10^{14}$ Ω·cm in volume resistivity and 0.07-0.1 mm in thickness. The secondary transfer belt 81 may preferably be sufficiently hard such that a value of Young's modulus of 100 MPa or more and 10 GPa or less as measured by a tensile test method (JIS K6301).

Further, in this embodiment, the patch toner and the fog toner which are deposited on the secondary transfer belt 81 are removed and collected from the secondary transfer belt 81 by the secondary transfer belt cleaning device 9 as a transfer material feeding member cleaning means.

3. General Structure of Secondary Transfer Belt Cleaning Device

Next, the secondary transfer belt cleaning device 9 will be described.

The cleaning device 9 includes a container 94 having an opening at a position opposing the secondary transfer belt 81. In the container 94, the cleaning device 9 includes a cleaning blade 91 as a first cleaning member, a fur brush 92 as a second cleaning member and a feeding screw 93 as a feeding member.

The cleaning blade 91 contacts the secondary transfer belt 81 wound partly around the driving roller 85. In this way, the cleaning blade 91 contacts the secondary transfer belt 81 toward the driving roller 85 which is firmly fixed at a predetermined position. As a result, the position of the cleaning blade 91 is stabilized, thus being suitable for stabilizing a cleaning performance. However, the position of the cleaning blade 91 is not limited thereto. The cleaning blade 91 is a substantially rectangular plate member in a planar view, and has a predetermined length with respect to a longitudinal direction and a short direction substantially perpendicular to the longitudinal direction and has a predetermined thickness. The cleaning blade 91 is disposed so that the longitudinal direction thereof extends along a direction crossing (in this embodiment, substantially perpendicular to) a movement direction of the secondary transfer belt 81 (i.e., a toner feeding direction by the secondary transfer belt 81. The cleaning blade 91 contacts the secondary transfer belt 81 at an edge portion (and/or edge surface) in one end portion (free end) side with respect to a short direction so that the free end is directed upward with respect to the movement direction of the secondary transfer belt 81 (counterdirectional contact). The cleaning blade 91 is constituted by a rubber material such as an urethane rubber.

The fur brush 92 is disposed upstream of the cleaning blade 91 with respect to the movement direction of the secondary transfer belt 81. In other words, the cleaning blade 91 is disposed downstream of the fur brush 92 with respect to the movement direction of the secondary transfer belt 81. Further, in this embodiment, the fur brush 92 contacts the secondary transfer belt 81 immediately before the secondary transfer belt 81 is wound partly around the driving roller 85. However, the position of the fur brush 92 is not limited thereto, but, e.g., similarly as in the case of the cleaning blade 91, the fur brush 92 may also be contacted to the secondary transfer belt 81 at a position where the secondary transfer belt 81 is wound partly around the driving roller 85. The fur brush 92 is rotationally driven in an arrow R4 direction in FIG. 1 by driving mechanism including a fur brush driving motor 95 as a driving source. That is, in this embodiment, the fur brush 92 is rotationally driven at a contact portion with the secondary transfer belt 81 so that movement directions of the secondary transfer belt 81 and the fur brush 92 are opposite to each other. The fur brush 92 includes a core metal and a raising portion constituted by a synthetic resin. The fur brush 92 is disposed so that a longitudinal direction (rotational axis direction) extends along a direction crossing (in this embodiment, substantially perpendicular to) the movement direction of the secondary transfer belt 81 (i.e., the toner feeding direction by the secondary transfer belt 81). That is, in this embodiment, the longitudinal directions of the cleaning blade 91 and the fur brush 92 are substantially parallel to each other.

The patch toner formed for image density adjustment and color registration and the fog toner deposited on the non-image portion during the development are secondary-transferred from the intermediary transfer belt 7 onto the secondary transfer belt 81 at the secondary transfer portion N2. Then, the toners are removed and collected from the secondary transfer belt 81 by the cleaning device 9. Specifically, a part of the toners on the secondary transfer belt 81 is removed from the secondary transfer belt 81 and then is collected in the container 94, and a remaining part of the toners is removed from the secondary transfer belt 81 by the fur brush 92 and then is collected in the container 94. The toners collected in the container 94 are fed to an outside of the cleaning device 9 by the feeding screw 93, and is finally fed and accommodated in an unshown collecting toner container (bottle).

The fur brush 92 is constituted by fibers formed of a resin material such as acrylic resin or nylon, and is capable of holding the toner in a predetermined amount. Further, as described above, the fur brush 92 is capable of not only removing, collecting and holding the toner but also re-coating the toner, held in the fur brush 92, little by little on the secondary transfer belt 81.

4. Reciprocating Operation

During the image formation, in general, the recording sheet frequently used as the transfer material P is fed through a nip between the intermediary transfer belt 7 and the secondary transfer belt 81. In that case, paper powder of the transfer material P is transferred onto the secondary transfer belt 81 and then is fed to the cleaning device 9. Most of the paper powder on the secondary transfer belt 81 is removed from the secondary transfer belt 81 by the fur brush 92 and then is collected in the container 94. However, in some cases, a part of the paper powder on the secondary transfer belt 81 slips through the fur brush 92 and reaches the cleaning blade 91, thus being sandwiched in the nip between the cleaning blade 91 and the secondary transfer belt 81. When this phenomenon generates, a gap is generated at a part of the nip by the sandwiched paper powder, so that the toner to be collected slips through the nip in some cases. Then, the toner slipped through the nip is returned to the secondary transfer portion N2, so that contamination of the transfer material P with the toner at the back surface of the transfer material P generates in some cases (back surface contamination).

Therefore, in this embodiment, the cleaning blade 91 is constituted so as to be capable of performing a reciprocating operation in a direction crossing the toner feeding direction by the secondary transfer belt 81. In this embodiment, a reciprocating operation direction of the cleaning blade 91 is substantially parallel to the longitudinal directions of the cleaning blade 91 and the fur brush 92. As a result, it is possible to obtain an effect such that the paper powder is not readily sandwiched between the cleaning blade 91 and the secondary transfer belt 81 and that even when the paper powder is sandwiched, the paper powder is removed (i.e., a shaking-off effect and a slip-through effect).

Incidentally, returning of the paper powder, slipped through the cleaning blade 91, to the transfer material P at the secondary transfer portion N2 is of no problem since it is difficult to visually recognize the paper powder as the back surface contamination. Further, in this embodiment, a position of the fur brush 92 with respect to the direction crossing the toner feeding direction by the secondary transfer belt 81 is fixed.

In this embodiment, the cleaning device 9 includes a reciprocating operation mechanism 96 for supporting the cleaning blade 91 so that the cleaning blade 91 is capable of being reciprocated. The reciprocating operation mechanism 96 may have any constitution so long as the cleaning blade 91 can be reciprocated thereby. In this embodiment, the reciprocating operation mechanism 96 includes a reciprocating operation motor **96*a* as a driving source and a supporting member 96*b* for not only performing a reciprocating operation by a driving force transmitted thereto from a reciprocating operation motor 96***a* but also supporting the cleaning blade 91. The supporting member 96*b* is mounted on the cleaning device 9, the secondary transfer unit 9 or a frame of a main assembly of the image forming apparatus 100 so as to permit the reciprocating operation in a manner such that a contact pressure of the cleaning blade 91 against the secondary transfer belt 81 is maintained. Further, between the reciprocating operation motor 96*a* and the supporting member 96*b*, a cam mechanism (not shown) for converting the driving force for rotational motion transmitted from the reciprocating operation motor 96 into a driving force for reciprocating motion is provided. For example, a driving force receiving portion such as an engaging projection is provided on the supporting member 96*b* or so as to be movable integrally with the supporting member 96*b*. Further, in a driving force transmitting system from the reciprocating operation motor 96*a*, a cylindrical groove cam, a cylindrical rib cam or an end surface cam or the like which is engageable with the driving force receiving portion is provided.

In order to satisfactorily exhibit paper powder removing power, the reciprocating operation may preferably be performed at a speed to some extent. In this embodiment, the cleaning blade 91 was reciprocated at a speed such that one reciprocation of a width (reciprocation range) of about 4 mm per second is made at a speed of about 8 mm/sec.

The cleaning blade 91 is counterdirectionally contacted to the secondary transfer belt 81, and scrapes off the toner on the secondary transfer belt 81. The toner scraped off by the cleaning blade 91 is dropped and collected into the container 94 by gravitation. However, a part of the toner is held in the nip between the cleaning blade 91 and the secondary transfer belt 81. The held toner constitutes a lubricant, and even when the rubber-made cleaning blade 91 is counterdirectionally contacted to the secondary transfer belt 81, generation of turning-up of the cleaning blade 91 is suppressed. However, the toner held at the nip moves from the nip with a time (execution of the image forming operation), thus decreasing in amount. For that reason, in the case where there is no periodical or continuous supply of the toner, the turning-up of the cleaning blade 91 can generate.

In view of this problem, in this embodiment, the fur brush 92 is disposed upstream of the cleaning blade 91 with respect to the movement direction of the secondary transfer belt 81. For that reason, the toner re-coated little by little from the fur brush 92 onto the secondary transfer belt 81 is supplied to the nip between the cleaning blade 91 and the secondary transfer belt 81. The toner performs the function of the lubricant, so that the generation of the turning-up of the cleaning blade 91 is suppressed.

However, as described above, depending on the width of the fur brush 92 with respect to the toner feeding direction by the secondary transfer belt 81, the turning-up of the cleaning blade 91 and toner scattering can generate. Particularly, in this embodiment, the cleaning blade 91 is reciprocated, and therefore in view of reciprocal movement thereof, there is a need to properly set a positional relation between the cleaning blade 91 and the fur brush 92.

5. Positional Relation Between Cleaning Blade and Fur Brush

Figure 2:
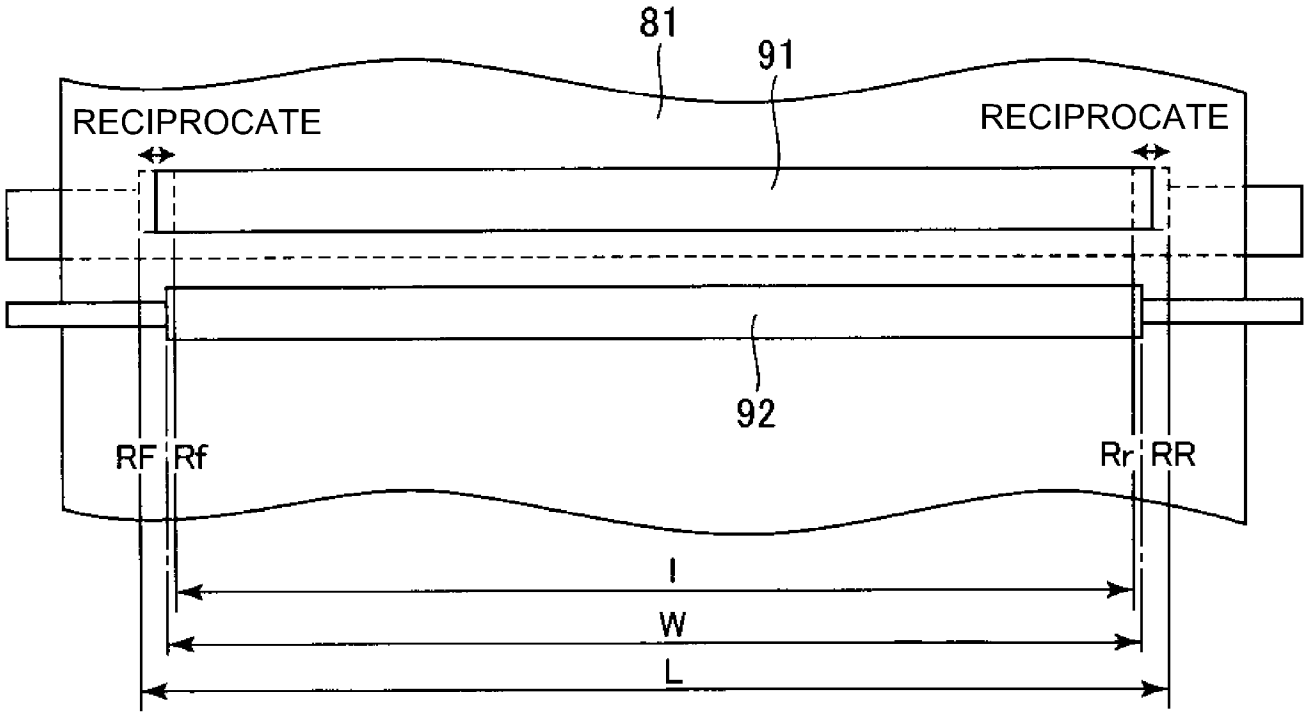
FIG. 2 is a schematic view showing a positional relation between a cleaning blade and a fur brush in Embodiment 1 of the present invention.

FIG. 2 is a schematic view showing a positional relation between the cleaning blade 91 and the fur brush 92 in this embodiment. FIG. 2 shows a state in which the cleaning blade 91 and the fur brush 92 are seen in an arrow A direction in FIG. 1. In FIG. 2, the container 94 is omitted.

In this embodiment, a left side in FIG. 2 (a front side on the drawing sheet of FIG. 1) is the front side, and a right side in FIG. 2 (a rear side on the drawing sheet of FIG. 1) is the rear side. In the case where widths (lengths) and end portion positions of the cleaning blade 91 and the fur brush 92 are mentioned, they are those in a contact region with the intermediary transfer belt 81. Further, the toner feeding direction by the secondary transfer belt 81 is also simply referred to as the toner feeding direction, and the reciprocating operation direction of the cleaning blade 91 is also simply referred to as a blade reciprocating operation direction.

With respect to the end portion positions of the cleaning blade 91 with respect to the blade reciprocating operation direction, a position when the front-side end portion is positioned at a rearmost side by the reciprocating operation is Rf, a position when the rear-side end portion is positioned at a frontmost side is Rr, and a width therebetween is 1. At this time, in this embodiment, a width W of the fur brush 92 with respect to the blade reciprocating operation direction is made wider than the width 1. In other words, the end portions of the fur brush 92 are disposed outside a minimum width range 1 between the end portion positions of the cleaning blade 91 in a movement locus of the cleaning blade 91 by the reciprocating operation. As a result, even when the amount of the toner supplied from the intermediary transfer belt 7 to the secondary transfer belt 81 decreases, the supply of the toner from the fur brush 92 to the entire region of the cleaning blade 91 is continued, so that the turning-up of the cleaning blade 91 is continuously suppressed.

Further, with respect to the end portion positions of the cleaning blade 91 with respect to the blade reciprocating operation direction, a position when the front-side end portion is positioned at a frontmost side by the reciprocating operation is RF, a position when the rear-side end portion is positioned at a rearmost side is RR, and a width therebetween is L. At this time, in this embodiment, a width W of the fur brush 92 with respect to the blade reciprocating operation direction is made narrower than the width L. In other words, the end portions of the fur brush 92 are disposed inside a maximum width range L between the end portion positions of the cleaning blade 91 in a movement locus of the cleaning blade 91 by the reciprocating operation. As a result, the amount of the toner outside the end portions of the cleaning blade 91 with respect to the blade reciprocating operation direction can be minimized, so that a degree of the toner scattering at the end portions of the cleaning blade 91 can be reduced.

That is, in this embodiment, the cleaning device 9 for reciprocating the toner on the toner carrying member is constituted as follows. The cleaning device 9 includes the fur brush 92 which contacts the secondary transfer belt 81 and which extends in the direction crossing the toner feeding direction. Further, the cleaning device 9 includes the cleaning blade 91 which contacts the secondary transfer belt 81 in the downstream side of the fur brush 92 with respect to the toner feeding direction and which extends in the direction crossing the toner feeding direction. Further, the cleaning blade 91 is constituted so as to be reciprocated in the direction crossing the toner feeding direction. Further, the end portion positions of the fur brush 92 with respect to the blade reciprocating operation direction are disposed between associated positions of the cleaning blade 91 with respect to the blade reciprocating operation direction when the end portion positions are positioned at associated extreme ends (RF and RR), respectively, of the cleaning blade 91. As a result, the toner re-coated on the toner carrying member 81 by the fur brush 92 is supplied to the entire region of the cleaning blade 92, so that the turning-up of the cleaning blade 91 can be suppressed. Further, with respect to the blade reciprocating operation direction, the supply of unnecessary toner to the outside of each of the end portions of the cleaning blade 91 is suppressed, so that the degree of the toner scattering at the end portions of the cleaning blade 91 can be suppressed to a minimum.

Figure 3:
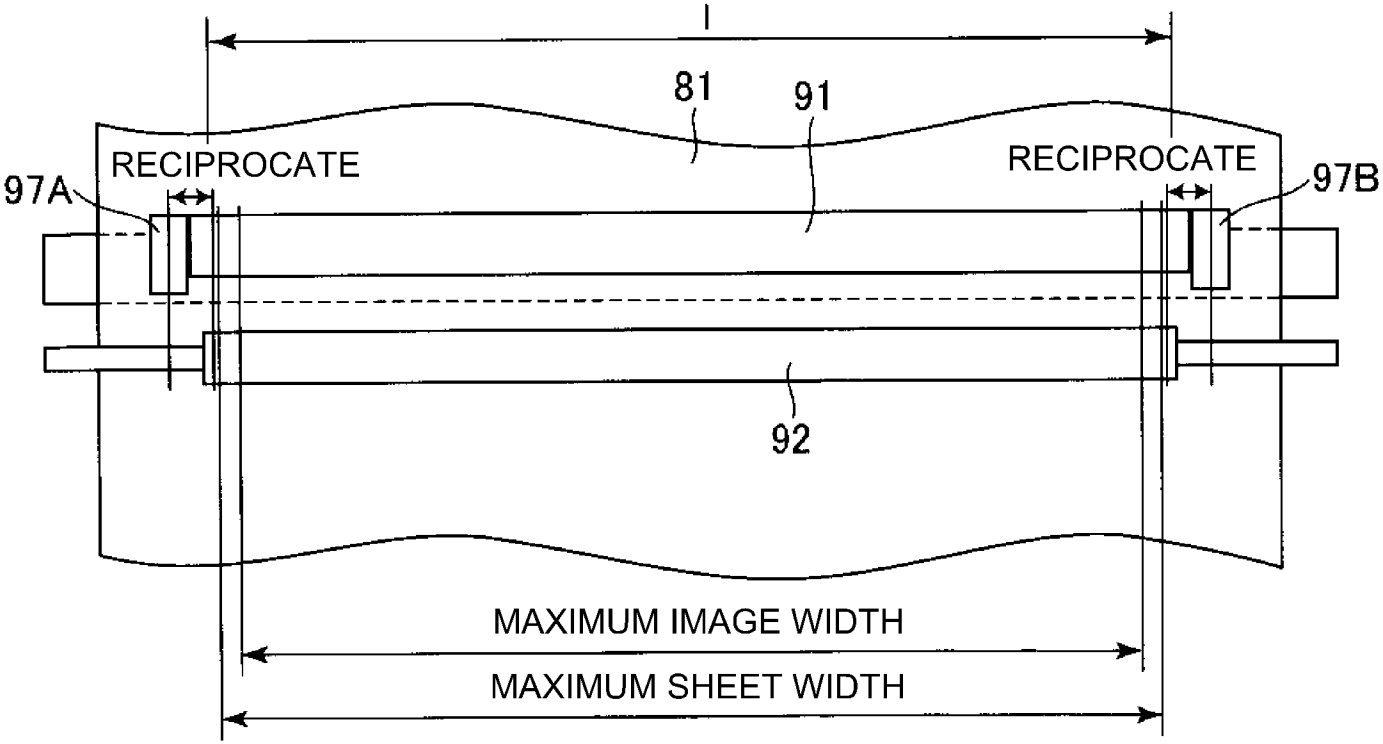
FIG. 3 is a schematic view showing a positional relation among the cleaning blade, the fur brush and end portion seals in Embodiment 1 of the present invention.

Further, in this embodiment, as shown in FIG. 3, at end portions of the cleaning blade 91 with respect to the blade reciprocating operation direction, end portion seal 97 (a front end portion seal 97A and a rear end portion seal 97B) as sealing members are provided in contact with the cleaning blade 91. FIG. 3 is a schematic view as seen in the same direction as in the case of FIG. 2 in the case where the end portion seals 97 are added. Each of the end portion seals 97 is constituted by a foamed elastic member (sponge) or felt.

Each of the end portion seals 97 seals the associated end portion of the cleaning blade 91 and seals the associated end portion of the cleaning blade 91 in contact with the secondary transfer belt 81. Further, the end portion seals 97 are reciprocated together with the cleaning blade 91. Also when the cleaning blade 91 is reciprocated, a spacing between each end portion seal 97 and the cleaning blade 91 is maintained in a substantially eliminated (removed) state. As a result, movement of the toner, carried and fed by the secondary transfer belt 81, toward the back surface of the cleaning blade 91 is suppressed. When a degree of the toner movement toward the back surface of the cleaning blade 91 becomes large, the toner scattering can be generated. In addition, the cleaning blade 91 flattens from the surface of the secondary transfer belt 81 to generate defective cleaning in some cases. In this embodiment, an end portion of each end portion seal 97 in a side opposite from the cleaning blade 91 with respect to the blade reciprocating operation direction is always disposed outside the fur brush 92 with respect to the blade reciprocating operation direction. As a result, with respect to the blade reciprocating operation direction, the toner positioned in a slight amount outside the cleaning blade 91 is collected by sealing a range, outside the fur brush 92 with respect to the blade reciprocating operation direction, with the associated end portion seal 97. Accordingly, it is possible to suppress the toner scattering and defective cleaning described above.

Incidentally, as shown in FIG. 3, in this embodiment, a maximum image width with respect to a main scanning direction (substantially perpendicular to the movement direction of the photosensitive drum 1, the intermediary transfer belt 7 and the secondary transfer belt 81) is narrower than the width 1. Accordingly, it becomes possible to clean the entire image width region by the cleaning blade 91. Further, in this embodiment, a maximum sheet width of a sheet passable in the main scanning direction is narrower than the width W of the fur brush 92 with respect to the same direction. Accordingly, most of the paper powder generated from the entire sheet width can be removed and collected by the fur brush 92. Further, as described above, a part of the paper powder which slips through the fur brush 92 to reach the cleaning blade 91 is sandwiched between the cleaning blade 91 and the secondary transfer belt 81 in some cases. This paper powder is removed by the reciprocating operation of the cleaning blade 91 as described above (shaking-off effect and slip-through effect). Further, another part of the paper powder which slips through the fur brush 92 to reach the cleaning blade 91 is collected by the end portion seals 97.

As described above, according to this embodiment, it is possible to not only remove a foreign matter such as the paper powder sandwiched between the secondary transfer belt 81 and the cleaning blade 91 but also supply the toner in a necessary and sufficient amount from the fur brush 92 to the cleaning blade 91. As a result, it is possible to not only suppress the formation of the spacing between the cleaning blade 91 and the secondary transfer belt 81 by the foreign matter but also compatibly realize suppression of the turning-up of the cleaning blade 91 and suppression of the toner scattering at the end portions of the cleaning blade 91.

Embodiment 2

Next, another embodiment of the present invention will be described. Basic constitutions and operations of the image forming apparatus, the secondary transfer belt and the cleaning device in this embodiment are the same as those in Embodiment 1. Accordingly, elements having the same or corresponding functions and constitutions are represented by the same reference numerals or symbols and will be omitted from detailed description.

In this embodiment, the shape of the end portion seals 97 (the front end portion seal 97A and the rear end portion seal 97B) is different from the shape in Embodiment 1.

Figure 4:
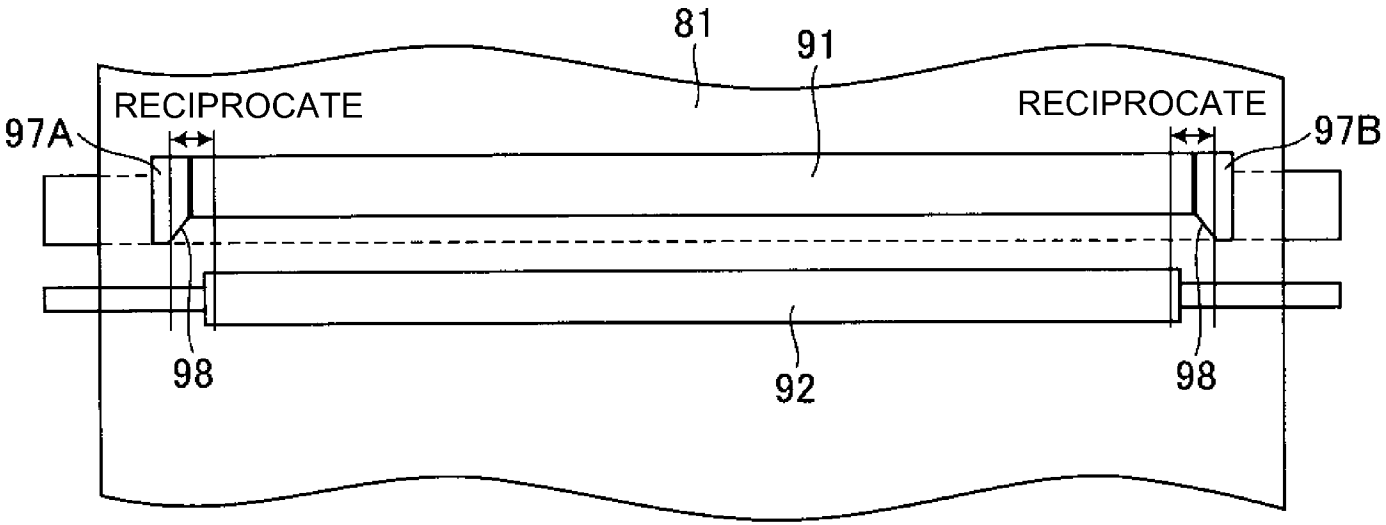
FIG. 4 is a schematic view showing a positional relation among the cleaning blade, the fur brush and end portion seals in Embodiment 1 of the present invention.
Figure 5:
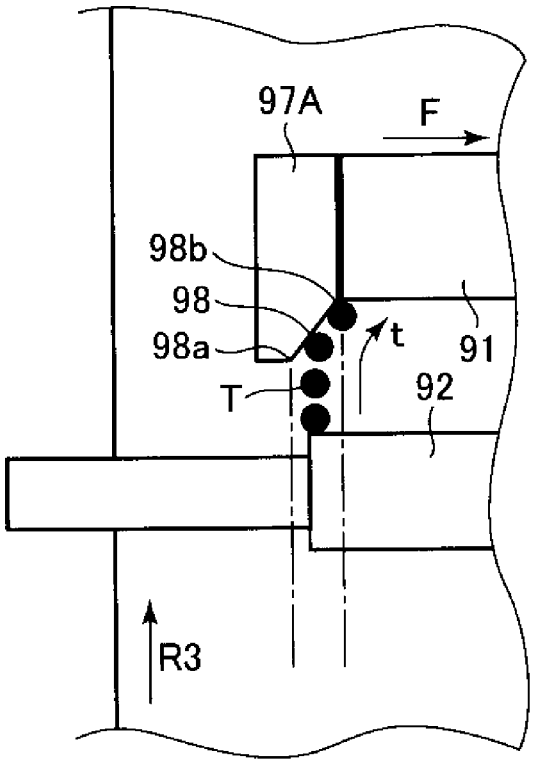
FIG. 5 is an enlarged view of a portion in the neighborhood of one of the end portion seals in Embodiments 2 of the present invention.

FIG. 4 is a schematic view showing a positional relation among the cleaning blade 91, the fur brush 92 and the end portion seals 97. FIG. 4 shows a state as seen in the same direction as those in the cases of FIGS. 2 and 3. FIG. 5 is an enlarged view of these members in the neighborhood of the front end portion.

As shown in FIGS. 4 and 5, in this embodiment, each of the end portion seals 97 is partly provided with a tapered portion (tapered surface) 98. The tapered portion 98 extends, from an end portion (end point) 98*b* in a contact portion side with the end portion of the cleaning blade 91 to an end portion (starting point) 98*a* in an opposite side from the contact portion, toward an upstream side with respect to the member direction of the secondary transfer belt 81. Further, the starting point 98*a* of the tapered portion 98 is always disposed outside the fur brush 92 with respect to the blade reciprocating operation direction.

FIG. 5 shows a state in which the cleaning blade 91 and the end portion seal 97A is shifted together in an arrow F direction (toward the rear side) in FIG. 5 to the maximum. At this time, with respect to the blade reciprocating operation direction, the front end portion of the fur brush 92 is positioned outside the front end portion of the cleaning blade 91. For that reason, the toner T re-coated on the secondary transfer belt 81 is carried, by the fur brush 92, outside the front end portion of the cleaning blade 91 along the movement direction R3 of the secondary transfer belt 81 (i.e., the toner feeding direction by the secondary transfer belt 81). However, this toner T is, after reaching the tapered portion 98 of the end portion seal 97A, returned toward the cleaning blade 91 along the tapered portion 98 as shown by an arrow t in FIG. 5. That is, by the tapered portion 98, it is possible to carry the toner toward the cleaning blade 91. As a result, the toner T is scraped off from the secondary transfer belt 81 by the cleaning blade 91, and then is dropped and collected into the container 94. Also by the rear end portion seal 97B, the same operation (substantially symmetrical to that in the case of the front end portion seal 97A) is performed.

That is, in this embodiment, the end portion seals 97 extend toward the upstream side of the cleaning blade 91 with respect to the toner feeding direction. Further, each of the end portion seals 97 has the tapered portion 98 formed, in the upstream side with respect to the toner feeding direction, so as to approach the cleaning blade 91 from the upstream side toward the downstream side with respect to the toner feeding direction. Further, the end portion (starting point) 98*a* of the tapered portion 98 in the upstream side with respect to the toner feeding direction is always disposed outside the fur brush 92. The end portion (end point) 98*b* of the tapered portion in the downstream side with respect to the toner feeding direction is disposed at the substantially same position as or upstream of the end portion of the cleaning blade in the upstream side with respect to the toner feeding direction. As a result, the toner is returned toward the cleaning blade 91 by the tapered portion 98 of the end portion seal 97, and therefore the amount of the toner held by the end portion seal 97 is decreased, so that durability of the end portion seal 97 is improved.

As described above, according to this embodiment, not only an effect similar to that in Embodiment 1 can be obtained, but also a toner collecting property at the end portions of the cleaning blade 91 can be further enhanced by the tapered portions 98 of the end portion seals 97.

Other Embodiments

The present invention was described above based on specific embodiments, but is not limited thereto.

For example, in the above-described embodiments, the case where the present invention is applied to the cleaning device for the secondary transfer belt as the toner carrying member, but the present invention is not limited thereto. The present invention is applicable to also a cleaning device for removing the toner on the image bearing member, such as the intermediary transfer belt or the photosensitive drum, as the toner carrying member.

Further, in the above-described embodiment, the brush position with respect to the direction crossing the toner feeding direction by the toner carrying member is fixed, but the brush may also be constituted so as to be reciprocated in the direction crossing the toner feeding direction by the toner carrying member. Also in this case, effects similar to those in the above-described embodiments by setting the end portion positions of the brush, to be reciprocated, relative to the end portion positions of the cleaning blade to be reciprocated.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 268054/2013 filed Dec. 25, 2013, which is hereby incorporated by reference.

What is claimed is:

1. An image forming apparatus comprising:

an image bearing member configured to bear a toner image;

a movable belt configured to feed a recording material onto which the toner image is to be transferred from said image bearing member at a transfer portion;

a cleaning blade, in contact with an outer peripheral surface of said belt and extending in a width direction crossing a movement direction of said belt, configured to remove toner deposited on said belt;

a reciprocating mechanism configured to reciprocate said cleaning blade in the width direction so that one end portion thereof is moved in a range from a first position to a second position and another end portion thereof is moved in a range from a third position to a fourth position, wherein in the first position, the one end portion is at an outermost position on one end portion side of said cleaning blade, in the second position, the one end portion is at an innermost position on the one end portion side, in the third position, the other end portion is at an innermost position on another end portion side of said cleaning blade, and in the fourth position, the other end portion is at an outermost position on the other end portion side; and a brush, in contact with the outer peripheral surface of said belt and extending in the width direction, configured to remove the toner deposited on said belt, wherein said brush is provided upstream of said cleaning blade and downstream of the transfer portion with respect to the movement direction of said belt so that one end portion of said brush is disposed between the first and second positions and the other end portion of said brush is disposed between the third and fourth positions.

2. An image forming apparatus according to claim 1, wherein a seal member is disposed at each of the end portions of said cleaning blade with respect to the width direction, each of the seal members contacts both the associated end portion of said cleaning blade and the outer peripheral surface of said belt, and both of the seal members reciprocate integrally with said cleaning blade, and wherein with respect to the width direction, a position of an outside end portion of each of the seal members is disposed outside a position of an associated end portion of said brush, even when one of the seal members moves to a maximum extent toward a side where the other seal member is provided.

3. An image forming apparatus according to claim 2, wherein each of the seal members includes a tapered portion extending from a neighborhood of a first point, which is an upstreammost position of said cleaning blade with respect to the movement direction at one of the end portions of said cleaning blade with respect to the width direction, toward a second point so that the tapered portion extends in a direction opposite to the movement direction with an increasing distance from the neighborhood of the first point toward an outside thereof with respect to the width direction, and wherein a position of the second point is disposed outside a position of an associated end portion of said brush even when the one of the seal members moves to the maximum extent toward the side where the other seal member is provided.

4. An image forming apparatus according to claim 3, wherein a starting point of the tapered portion is disposed substantially at the same position as the first point or disposed at a position upstream of the first point with respect to the movement direction.

5. An image forming apparatus according to claim 1, wherein said belt is stretched by a plurality of rollers, and wherein said cleaning blade is contacted to said belt toward one of the plurality of rollers.

* * * * *